US006843180B1

(12) United States Patent
Keaton

(10) Patent No.: US 6,843,180 B1
(45) Date of Patent: Jan. 18, 2005

(54) ANTI-TIP ARRANGEMENT FOR A MOBILE STORAGE SYSTEM

(75) Inventor: William R. Keaton, Brookfield, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 10/354,417

(22) Filed: Jan. 30, 2003

(51) Int. Cl.[7] ..... B61F 9/00
(52) U.S. Cl. ..... 104/248; 312/201
(58) Field of Search ..... 104/242, 248, 104/244.1, 245, 246, 247, 251; 312/201; 16/90, 94 R

(56) References Cited

U.S. PATENT DOCUMENTS 4,618,191 A 10/1986 Peterman
4,789,210 A 12/1988 Weiss et al.
5,013,101 A * 5/1991 Muth ..... 312/201
5,050,504 A * 9/1991 Mulcaster ..... 104/242
5,205,627 A 4/1993 Davison et al.
5,435,639 A 7/1995 Smits et al.
5,597,217 A 1/1997 Hoska et al.
6,161,485 A * 12/2000 Muth ..... 105/96

* cited by examiner

*Primary Examiner*—Mark T. Le
(74) *Attorney, Agent, or Firm*—Boyle, Fredrickson, Newholm, Stein & Gratz, S.C.

(57) ABSTRACT

An anti-tip arrangement for a mobile system, such as a mobile storage system, in which a movable member is mounted to a rail arrangement. The anti-tip arrangement includes an anti-tip member which is pivotably mounted to the movable member for movement between an operative position and an inoperative position. The anti-tip member has a hook section that is engageable with an engagement surface of the rail arrangement, for preventing tipping of the movable member relative to the rail arrangement. The anti-tip member further includes a retainer section and a tab section that extend in opposite directions from the pivot axis about which the anti-tip member is pivotable. The tab section extends laterally from the pivot axis, and is engageable by a user to enable the user to pivot the anti-tip member to the operative position. The retainer section is offset from the tab section, and is adapted to receive a releasable retainer member, such as a retainer pin, which maintains the anti-tip member in the operative position. The offset of the tab section from the retainer section facilitates the ability of the user to manipulate the anti-tip member for movement to the operative position while engaging the retainer pin with the retainer section.

20 Claims, 4 Drawing Sheets

FIG. 3
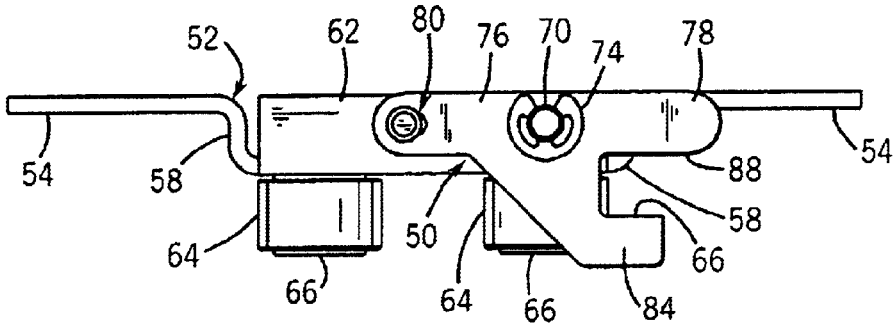
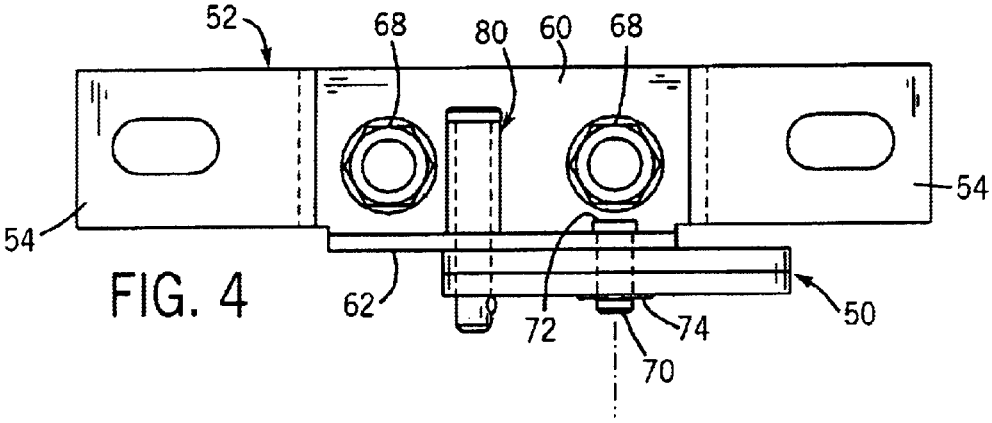
FIG. 4
FIG. 5
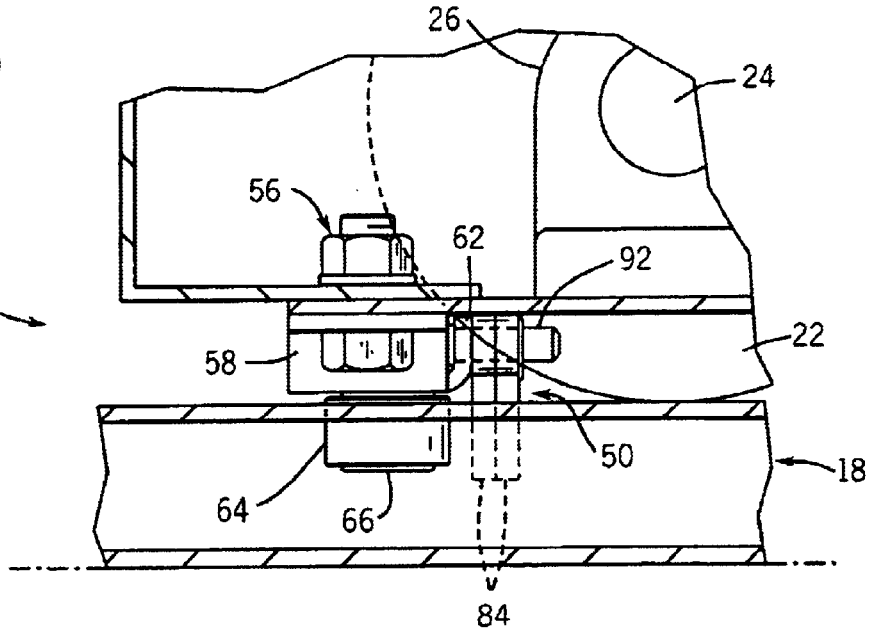

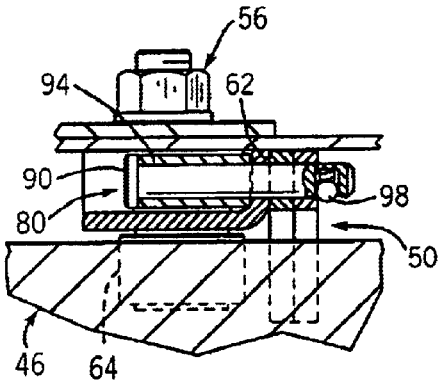
FIG. 7
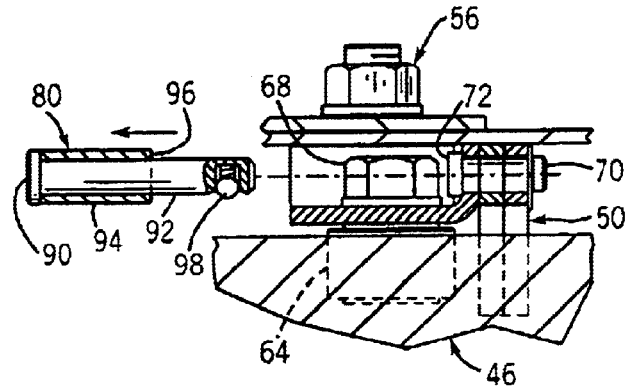
FIG. 8
FIG. 9
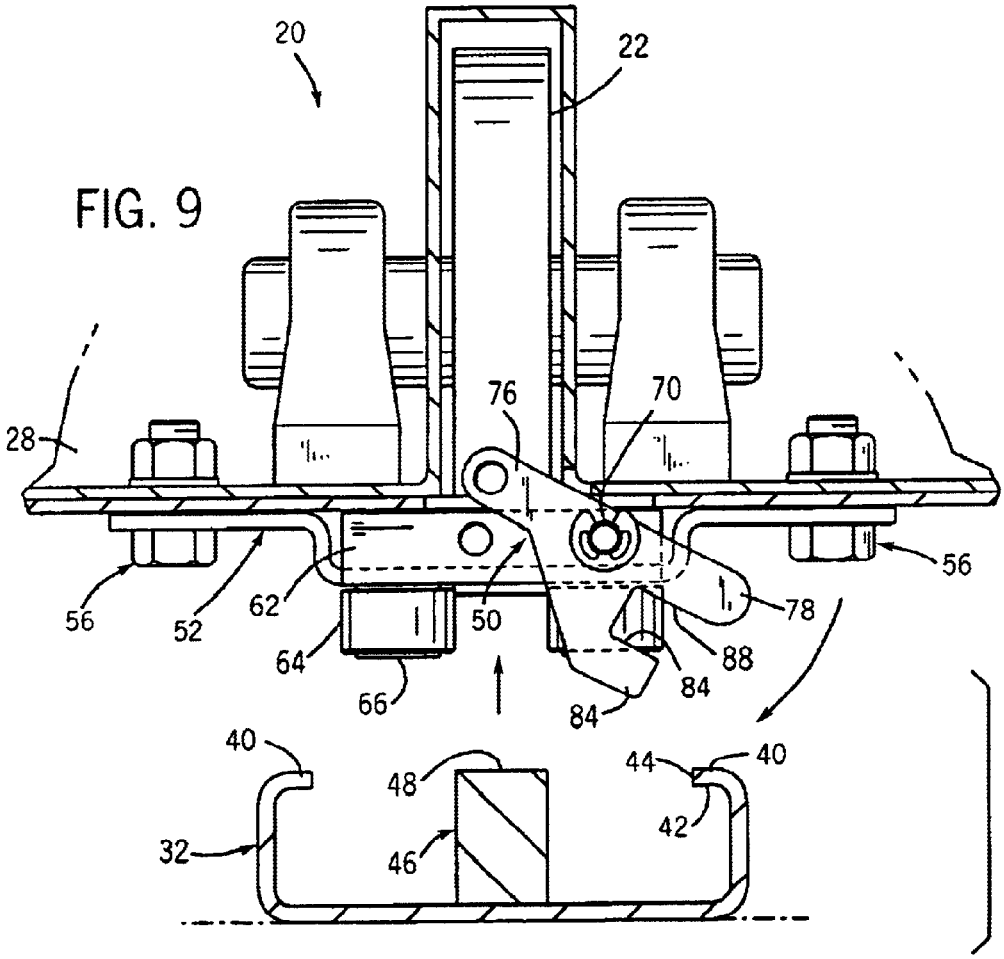

ANTI-TIP ARRANGEMENT FOR A MOBILE STORAGE SYSTEM

BACKGROUND AND SUMMARY OF THE INVENTION

This invention relates to a rail-mounted mobile system such as a mobile storage system, and more particularly to an anti-tip arrangement for such a system.

A rail-mounted mobile system, such as a mobile storage system, includes one or more movable members supported on a series of spaced apart parallel rails. In a mobile storage application, the movable members are typically in the form of carriages having wheels that are supported on the spaced apart rails. A series of storage units, such as shelves or cabinets, are mounted to each carriage.

Various anti-tip arrangements are known for preventing the carriage-mounted storage units from tipping relative to the rails. One example of such an anti-tip arrangement is shown and described in Peterman U.S. Pat. No. 4,618,191, the disclosure of which is hereby incorporated by reference. The '191 patent discloses an anti-tip system in which a groove is formed in the side of the rail. An anti-tip member is carried by the carriage, and is pivotably mounted to the carriage for movement between an operative position and an inoperative position. In the operative position, a hook section of the anti-tip member is engaged within the groove in the rail. In the inoperative position, the hook section of the anti-tip member is positioned out of engagement with the groove in the rail. The anti-tip member further includes a retainer section which is adapted to receive a releasable retainer such as a pin, for selectively maintaining the anti-tip member in the operative position. The hook section and the retainer section are located on the same side of the pivot axis about which the anti-tip member is pivotable between the operative and inoperative positions. With this construction, the retainer section and the hook section hang downwardly when the anti-tip member is in the inoperative position. The anti-tip member is pivoted from the inoperative position to the operative position when the carriage is mounted to the rail, either by engaging the retainer section and applying an upward force or by engaging the hook section and applying an inward force. The retainer section of the anti-tip member is located over the rail, and access to the retainer section of the anti-tip member is complicated by the components of the carriage located vertically above the retainer section of the anti-tip member. The hook section is accessible from the side, which is also complicated by the components of the carriage. In addition, the hook member is located within a space defined between the rail and a base member to which the rail is mounted, and the base obstructs access to the hook member. Thus, in either case, it is difficult for a user to manipulate the retainer section of the anti-tip member in order to move the anti-tip member from the disengaged position to the engaged position, and to simultaneously engage the retainer pin with the retainer section of the anti-tip member when the anti-tip member is in the operative position.

In another construction, the rail includes an upwardly facing base or channel to which a support bar is mounted, to reduce the overall height of the rail. The channel includes a lip that extends inwardly toward the support bar. An anti-tip arrangement for this type of rail construction utilizes a C-shaped anti-tip member that is engaged with the carriage after the carriage is mounted to the rail. The anti-tip member includes an upper section that is mounted to the carriage, and a lower section that is received within the space defined between the lip of the channel and the lower wall of the channel, to prevent the carriage from tipping relative to the rail. While this arrangement is functional, it is disadvantageous in that the anti-tip member is separate from the carriage and is mounted to the carriage after the carriage is mounted to the rail.

It is an object of the present invention to provide an anti-tip arrangement for a mobile system, such as a mobile storage system, which provides quick and easy movement of an anti-tip member from an inoperative position to an operative position when the movable member is mounted to the support surface of the rail arrangement. It is a further object of the invention to provide such an anti-tip arrangement in which the anti-tip member is carried by the movable member, to eliminate the need for a separate anti-tip member which is engaged with the movable member subsequent to placement of the movable member on the rail arrangement. It is a further object of the invention to provide such an anti-tip arrangement in which separate areas of the anti-tip member are employed to move the anti-tip member to its operative position and to engage a releasable retainer arrangement with the anti-tip member for releasably retaining the anti-tip member in its operative position. Yet another object of the invention is to provide such an anti-tip arrangement which takes advantage of a channel-type rail construction for facilitating movement of the anti-lip member from its inoperative position toward its operative position.

In accordance with the present invention, a mobile system, such as a mobile storage system, includes a rail arrangement including a support surface and a laterally extending engagement area laterally offset from the support surface, in combination with a movable member adapted to be supported by the rail arrangement. The movable member engages the support surface of the rail arrangement for movably supporting the movable member on the rail arrangement. An anti-tip arrangement is interposed between the rail arrangement and the movable member. The anti-tip arrangement includes a pivotable anti-tip member carried by the movable member, which is pivotable about a pivot axis between an operative position and an inoperative position. The anti-tip member includes a hook section which is engageable with the engagement area of the rail arrangement to prevent tipping of the movable member relative to the rail arrangement. The anti-tip member further includes a tab or finger section that is spaced from the hook section, and which is adapted to be manually engaged by a user for placing the anti-tip member in the operative position. The anti-tip arrangement further includes a releasable retainer arrangement for releasably retaining the anti-tip member in the operative position. The hook section of the anti-tip member is located below and adjacent the engagement area of the rail arrangement when the anti-tip member is in the operative position. The tab or finger section of the anti-tip member is located above the laterally extending engagement area of the rail arrangement.

The releasable retainer arrangement includes a retainer section defined by the anti-tip member, and a releasable engagement member, such as a retainer pin, which is engageable with the retainer section and with the movable member for selectively maintaining the anti-tip member in the operative position. In a preferred embodiment, the retainer section and the tab or finger section of the anti-tip member extend in opposite directions from the pivot axis of the anti-tip member.

The rail arrangement may be in the form of an upwardly facing channel member to which a support bar is mounted.

The support bar defines the support surface of the rail arrangement, and the channel member includes a side wall having an inwardly extending lip that defines the laterally extending engagement area of the rail arrangement. A space is located between the support bar and the inwardly extending lip. The anti-tip member is configured such that the tab or finger section engages the inwardly extending lip of the channel member as the movable member is moved into engagement with the support surface of the support bar, to move the anti-tip member toward the operative position from the inoperative position.

The invention contemplates a mobile storage system having an anti-tip arrangement as summarized above, as well as a method of engaging an anti-tip member with a rail arrangement in a mobile system and an improvement in a mobile system in which a movable member is movably supported on a rail arrangement, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is an elevation view of the anti-tip member of the present invention as shown in FIG. 2, and components for mounting the anti-tip member to the movable member of the mobile storage system;

FIG. 4 is a top plan view of the anti-tip member and mounting components as shown in FIG. 3;

FIG. 5 is a partial section view taken along line 5—5 of FIG. 2;

FIG. 7 is a partial section view taken along line 7—7 of FIG. 2, showing a releasable retainer pin in an engaged position for retaining the anti-tip member in its operative position;

FIG. 8 is a view similar to FIG. 7, showing the releasable retainer pin in the disengaged position; and FIG. 9 is a view similar to FIG. 2, showing the anti-tip member pivoted to the inoperative position for enabling the carriage to be engaged with or disengaged from the rail arrangement.

DETAILED DESCRIPTION OF THE INVENTION

Figure 1:
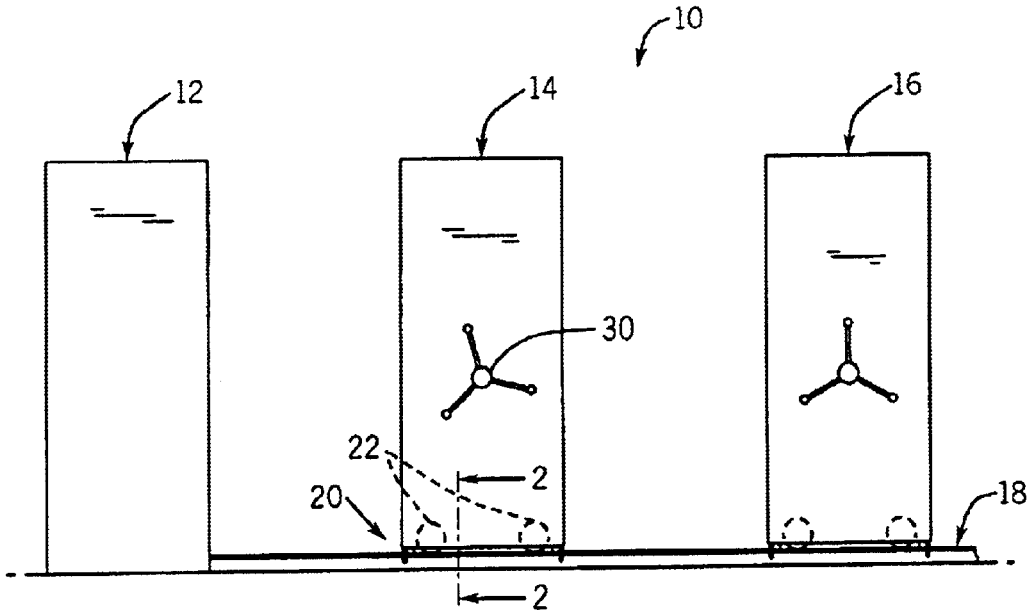
FIG. 1 is a side elevation view showing a mobile system, in the form of a mobile storage system, which incorporates the anti-tip arrangement of the present invention.

As shown in FIG. 1, a mobile system, in the form of a mobile storage system 10, includes a series of storage units 12, 14 and 16. Storage unit 12 is stationary, and storage units 14 and 16 are movably supported on a series of parallel, spaced apart rails 18 in a manner as is generally known. Storage units 14, 16 are movable on rails 18 together and apart, to selectively create an aisle or space for providing access to the contents of storage units 12, 14 and 16. Representatively, the general construction and operation of mobile storage system 10 is similar to that of mobile storage systems such as are available from Spacesaver Corporation of Fort Atkinson, Wis.

Figure 2:
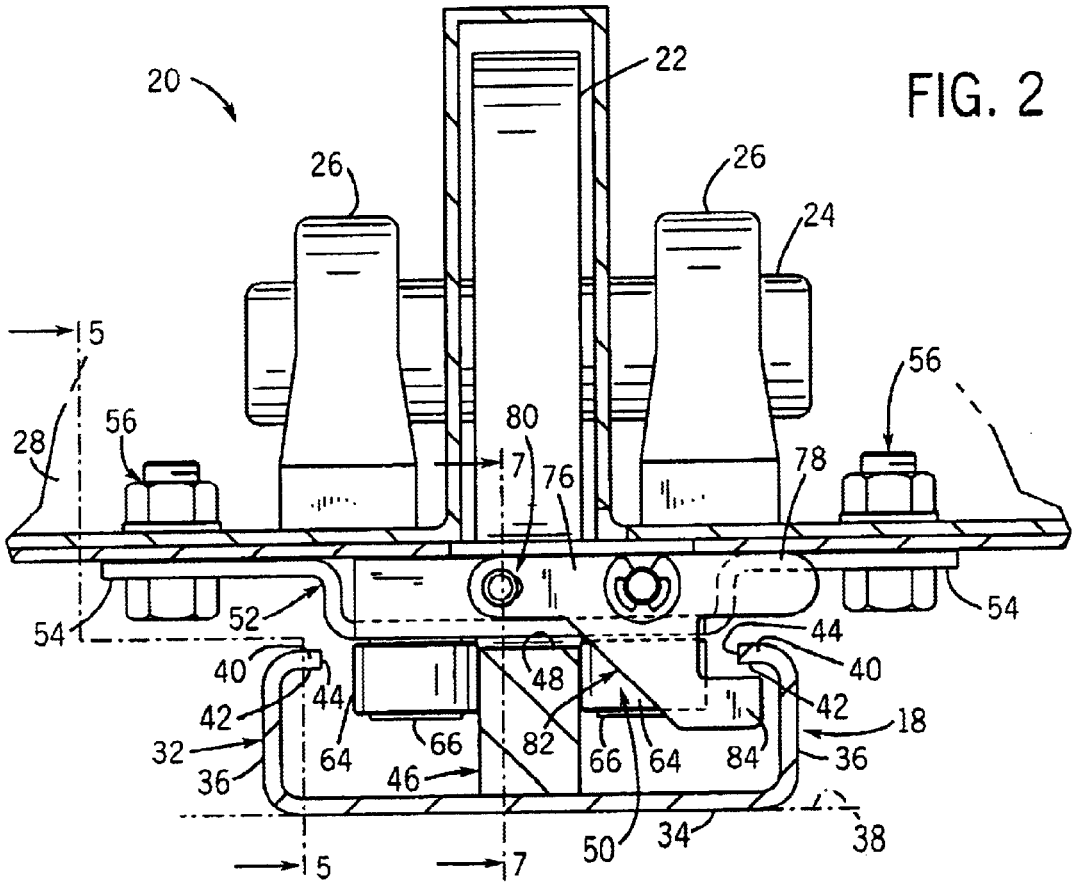
FIG. 2 is a partial section view taken along line 2—2 of FIG. 1.

Each of mobile storage units 14, 16 includes a carriage 20, the lower portion of which is shown in FIG. 2. In accordance with known construction, each carriage 20 spans across the parallel rails 18 for movably supporting the storage units 14, 16 on rails 18. Each carriage 20 includes a series of wheels 22, each of which is mounted to an axle 24 mounted for rotation within a pair of conventional bearing or pillow blocks 26. Alternatively, axles 24 may be rotatably supported by flange-mounted bearings rather than pillow blocks 26, or any other satisfactory arrangement may be used for rotatably supporting wheels 22. Carriage 20 includes a series of frame members, such as a horizontal frame member 28, to which wheels 22 are mounted. In a known manner, certain of wheels 22 are powered for longitudinal movement along rails 18 by a known manual or electric drive system. In a representative embodiment as illustrated in FIG. 1, a manual hand wheel 30 provides input power to the drive arrangement, which typically incorporates a chain and sprocket drive (not shown) for driving a selected one of axles 24 through rotation of hand wheel 30.

Each rail 18 includes a base or channel member 32 having a bottom wall 34 and a pair of spaced apart side walls 36. Bottom wall 34 is adapted for placement on a support surface 38 such as a subfloor, such that channel member 32 is upwardly open. Each side wall 36 of channel member 32 extends upwardly from one of the ends of bottom wall 36, and terminates in an inwardly extending lip 40 at its upper end. The underside of each lip 40 defines a downwardly facing and laterally extending engagement surface 42. In the illustrated embodiment, each engagement surface 42 is spaced above and parallel to the upwardly facing surface of bottom wall 34. Each lip 40 terminates in an inwardly facing end 44.

Rail 18 further includes a longitudinally extending support member 46, which is mounted to bottom wall 34 of channel member 32 and is positioned generally midway between side walls 36. Support member 46 is in the form of a bar having a generally rectangular cross section, defining an upwardly facing support surface 48 with which wheels 22 are engaged for providing movement of carriage 20 along rail 18. The bottom surface of support member 46 is secured to channel member bottom wall 34, such as by welding.

An anti-tip member 50 is carried by carriage 20 so as to be movable along with the storage unit such as 14, 16. In the illustrated embodiment, anti-tip member 50 is secured to a bracket 52 which includes a pair of mounting flanges 54 that % are secured to carriage 20. In the illustrated embodiment, flanges 20 are secured to the underside of horizontal frame member 28 via bolt and nut connectors 56, although it is understood that any other satisfactory type of mounting method may be employed. As shown in FIGS. 2–4, bracket 52 further includes a vertically offset central section including a pair of spaced apart side walls 58 and a lower wall 60. An upstanding, forwardly facing mounting wall 62 extends upwardly from the forward edge of lower wall 60.

A pair of tracking rollers 64 are secured to lower wall 60 of bracket 52. Tracking rollers 64 are in horizontal alignment with each other, and the spacing between tracking rollers 64 is only slightly greater than the width of support bar 46 of rail 18. Tracking rollers 64 are positioned on carriage 20 so as to be located below the lower extent of wheel 22, and are adapted to engage the upper side surfaces of support bar 46 to maintain carriage 20 in a proper lateral position relative to rail 18, i.e. to ensure that wheel 22 maintains engagement with support surface 48 of support member 46. While tracking rollers 64 are illustrated, it is also understood that a similar function may be provided by a circular rib that extends outwardly from the outwardly facing engagement surface of wheel 22 and is received within a groove formed in support surface 48 of support member 46. In addition, it is understood that tracking rollers 64 may be mounted in any other satisfactory location on carriage 20. Each tracking roller 64 is rotatably supported on a vertical roller shaft 66, each of which extends through an opening in bracket lower wall 60 for engagement with a threaded nut 68, to secure tracking rollers 64 in position on bracket 52.

Anti-tip member 50 is pivotably mounted to mounting wall 62 of bracket 52 for movement between an operative position as shown in FIGS. 2–8 and an inoperative position as shown in FIG. 9. With reference to FIGS. 3–5, anti-tip member 50 is pivotably mounted to mounting member 62 via a pivot pin 70 that extends through an opening in mounting wall 62 and an aligned opening in anti-tip member 50. Pivot pin 70 includes a head 72 that engages the inner surface of mounting wall 62. A retainer ring 74 is engaged within a groove formed in the outer end of pivot pin 70, to maintain pivot pin 70 in position so as to pivotably mount anti-tip member 50 to mounting wall 62.

Anti-tip member 50 includes an upper area defining a retainer section 76 and a tab section 78 that extend in opposite directions relative to pivot pin 70. Retainer section 76 includes an opening adapted to receive a retainer member in the form of a retainer pin 80, for releasably maintaining anti-tip member 50 in its operative position. Anti-tip member 50 further includes a hook section 82 that extends downwardly from and is joined to retainer section 76 and tab section 78. Hook section 82 terminates in a lower hook member 84, which is spaced below tab section 78. In the illustrated embodiment, hook member 84 and tab section 78 extend laterally along generally parallel longitudinal axes. Hook member 84 includes an upwardly facing engagement edge 86, which is spaced from a lower edge 88 defined by tab section 78.

Figure 6:
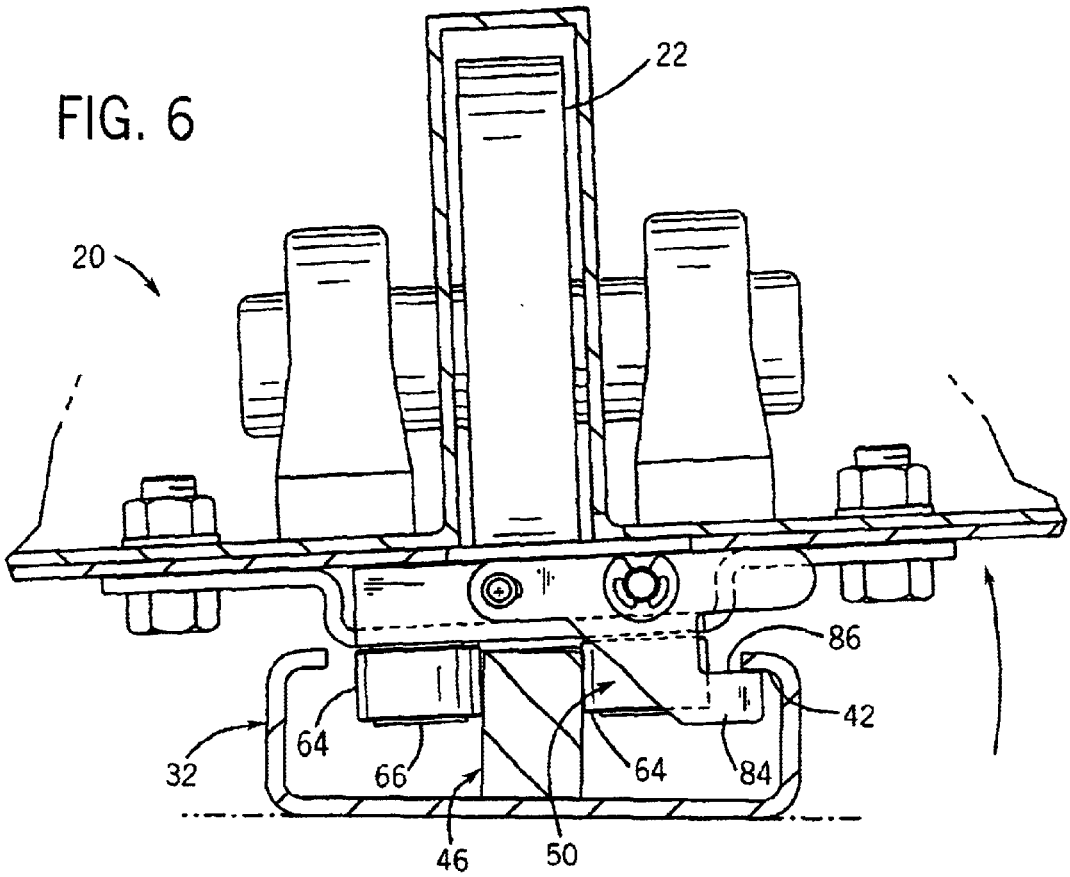
FIG. 6 is a view similar to FIG. 2, showing operation of the anti-tip member of the present invention for preventing tipping movement of the carriage relative to the rail arrangement.

When anti-tip member 50 is in the operative position as shown in FIG. 2, hook section 82 is disposed within the space defined between support member 46 and inner end 44 of lip 40. The outer end area of hook member 84 is located vertically below engagement surface 42 defined by lip 40. Engagement edge 86 of hook member 84 is adapted to contact engagement surface 42 of lip 40, as shown in FIG. 6, to prevent carriage 20 from tipping relative to rail 18, about either a longitudinal axis as shown in FIG. 6 or a transverse axis along the length of carriage 20. When anti-tip member 50 is in the operative position, tab section 78 of anti-tip member 50 is spaced vertically above lip 44 and is oriented substantially horizontally.

Referring to FIGS. 7–9, retainer pin 80 includes a head 90 and a shank 92 that extends from head 90 through a cylindrical sleeve 94 having an outer end 96 that defines a shoulder. Sleeve 94 also defines an inner end that engages the surface of head 90 located outwardly of shank 92. A spring biased retaining ball 98 is engaged with shank 92 of retainer pin 80 at its outer end. In an alternative construction, retainer pin 80 may be formed such that head 90, sleeve 94 and shank 92 are integrally formed together, such that the inner area of retainer pin 80 is a reduced diameter member that extends from a shoulder formed by the outer area of the retainer pin and to which spring biased retainer ball 98 is mounted.

The spacing between sleeve end 96 and retainer ball 98 is such that shank 92 outwardly of shoulder 96 is adapted to extend through the aligned openings in bracket mounting wall 62 and retainer section 76, as shown in FIG. 7, to releasably retain anti-tip member 50 in the operative position. Retainer pin 80 is adapted to be disengaged from mounting wall 62 and anti-tip member retainer section 76 as shown in FIG. 8, by application of an axial outward force to retainer pin 80. Retainer ball 78 operates in a known manner to extend when retainer pin 80 is engaged so as to maintain retainer pin 80 in position, and to retract when an axial force is applied to retainer pin 80 so as to enable shank 92 to be moved through the aligned openings in mounting wall 62 and retainer section 76, in either an inward direction or an outward direction.

In operation, anti-tip member 50 is in the inoperative position as shown in FIG. 9 prior to engagement of carriage 20 with rail 18. To place anti-tip member 50 in the inoperative position, retainer pin 80 is disengaged from anti-tip member 50. This enables anti-tip member 50 to pivot about pivot pin 70 downwardly (or clockwise with reference to FIG. 9), such that the upper edge of retainer section 76 engages an edge defined by frame member 28 to limit rotational movement of anti-tip member 50 and to place anti-tip member 50 in the inoperative position of FIG. 9. When in the inoperative position, anti-tip member 50 is positioned such that hook member 84 and tab section 78 are oriented at a downward angle relative to horizontal. As carriage 20 is moved toward and into engagement with rail 18, lower edge 88 of tab section 78 engages the upwardly facing surface of lip 40 or the adjacent floor surface as hook member 84 is inserted into the space defined between end 44 of lip 40 and the facing surface of support member 46. Such engagement of tab section 78 with lip 40 functions to pivot anti-tip member 50 upwardly (in a counterclockwise direction with reference to FIGS. 2 and 9), away from the inoperative position of FIG. 9 partially toward the operative position of FIG. 2. Such movement of anti-tip member 50 rotates hook member 84 upwardly toward engagement surface 42 of lip 40. Subsequent to engagement of carriage 20 with rail 18, tab section 78 rests on the upwardly facing surface of lip 40 or the adjacent floor surface located outwardly of lip 40.

The user then utilizes tab section 78 to pivot anti-tip member 50 to the operative position of FIG. 2. Tab section 78 extends laterally outwardly, which enables the user to engage tab section 78 with the user's finger. The user then applies an upward force on tab section 78 to lift tab section 78 upwardly and to thereby cause further counterclockwise rotation of anti-tip member 50 about pivot pin 70 to the operative position of FIG. 2. Alternatively, the user may employ any satisfactory tool, such as a screwdriver, to reach under carriage 20 and engage tab section 78. Such movement of anti-tip member 50 brings the opening in retainer section 76 into alignment with the opening in bracket mounting wall 62. The user then engages retainer pin 80 within the aligned openings in retainer section 76 and mounting wall 62 by applying an inward push-on force to retainer pin 80 sufficient to cause retraction of retainer ball 98 during passage of shank 92 through the aligned openings in retainer section 76 and mounting wall 62. Retainer pin 80 is placed in its engaged position as shown in FIG. 7, which functions to maintain anti-tip member 50 in the operative position. To subsequently move anti-tip member 50 to the inoperative position, the user reverses the above steps to disengage retainer pin 80, which allows anti-tip member 50 to pivot away from the operative position toward the inoperative position.

The aligned openings in retainer section 76 and mounting wall 62 are positioned so as to enable the user to insert retainer pin 80 from the front of carriage 20, as shown in FIG. 5, within a space defined between the underside of carriage 20 and the upper extent of rail 18 and the adjacent floor. Typically, retainer pin 80 is grasped between the user's fingers or is held using a conventional pliers or locking pliers, for push-on engagement of locking pin 80. The laterally offset position of tab section 78 relative to retainer section 76 facilitates the user's ability to hold anti-tip member 50 in the operative position prior to and during engagement of retainer pin 80, which makes engagement and disengagement of retainer pin 80 a much simpler operation than in the prior art.

While the invention has been shown and described with respect to a specific embodiment, it is understood that various alternatives and modifications are possible and are contemplated as being within the scope of the invention. For example, and without limitation, the retainer means by which the anti-tip member is maintained in the operative position is shown and described as a selectively engageable retainer pin. It is understood that any other type of retainer structure may be employed, such as a threaded connector or a releasable engagement arrangement interposed between the anti-tip member and the carriage. It is also understood that the finger or tab section that is employed to move the anti-tip member from the inoperative position to the operative position is not limited to the specific shape and configuration as illustrated, and that the finger or tab section may be in the form of any type of member that extends laterally outwardly from the pivot axis of the anti-tip member and is engageable by the user for imparting pivoting movement to the anti-tip member. In addition, it is understood that the illustrated and described construction of rail 18 is representative of many types of rail arrangements which may be used in combination with the anti-tip system of the present invention. For example, the inwardly extending horizontal engagement surface defined by lip 40 may be replaced with an outwardly extending engagement surface. A hat-shaped channel may be employed in place of the C-shaped channel as shown and described. The construction of the rail base member may be asymmetric rather than symmetric as shown. Further, the anti-tip member may be engageable with a surface of the support member rather than a channel or base member to which the support member is mounted. Essentially, the anti-tip member of the present invention may be used in connection with any type of rail construction having at least one laterally extending engagement surface with which the anti-tip member is engageable for preventing tipping of the carriage.

Various alternatives and embodiments are contemplated as being within the scope of the following claims particularly pointing out and distinctly claiming the subject matter regarded as the invention.

I claim:

1. A mobile storage system, comprising:

a rail arrangement including a support surface and a laterally extending lip that defines an engagement area laterally offset from the support surface;

a movable member adapted to be supported by the rail arrangement, wherein the movable member includes a wheel arrangement adapted to engage the support surface for movably supporting the movable member on the rail arrangement; and an anti-tip arrangement interposed between the rail arrangement and the movable member, comprising a pivotable anti-tip member carried by the movable member, wherein the anti-tip member includes a hook section and is pivotable about a pivot axis between an operative position and an inoperative position, wherein the hook section in the operative position underlies the engagement area of the rail arrangement to prevent tipping of the movable member relative to the rail arrangement, wherein the anti-tip member further includes a finger section spaced from the hook section, wherein the finger section overlies the lip of the rail arrangement and is adapted to be manually engaged by a user for placing the anti-tip member in the operative position, and wherein the anti-tip member further includes a retainer section that extends from the pivot axis in a direction opposite the finger section, and wherein the anti-tip arrangement further includes a releasable retainer member selectively engageable with the retainer section of the anti-tip member and the movable member for releasably retaining the anti-tip member in the operative position.

2. The mobile storage system of claim 1, wherein the rail arrangement includes a channel member and a rail member engaged with the channel member, wherein the support surface is defined by the rail member and wherein the lip of the rail arrangement is defined by the channel member.

3. The mobile storage system of claim 2, wherein the channel member defines a bottom wall and at least one side wall, wherein the lip extends inwardly from the side wall toward the rail member, and wherein an open area is defined between the lip and the rail member.

4. The mobile storage system of claim 3, wherein the hook section of the anti-tip member is disposed in the open area.

5. A mobile storage system, comprising:

a rail arrangement including a support surface and a laterally extending lip laterally offset from the support surface;

a movable member adapted to be supported by the rail arrangement wherein the movable member includes a wheel arrangement adapted to engage the support surface for movably supporting the movable member on the rail arrangement; and an anti-tip arrangement interposed between the rail arrangement and the movable member, comprising a pivotable anti-tip member carried by the movable member, wherein the anti-tip member includes a hook section and is pivotable about a pivot axis between an operative position and an inoperative position, wherein the hook section in the operative position is engageable with the engagement area of the rail arrangement to prevent tipping of the movable member relative to the rail arrangement, wherein the anti-tip member further includes a finger section spaced from the hook section, wherein the finger section is adapted to be manually engaged by a user for placing the anti-tip member in the operative position, and a releasable retainer arrangement for releasably retaining the anti-tip member in the operative position;

wherein the anti-tip member is configured such that, when the anti-tip member is in the operative position, the hook section of the anti-tip member is located below and adjacent the laterally extending lip of the rail arrangement and the finger section of the anti-tip member is located above the laterally extending lip of the rail arrangement;

wherein the rail arrangement is configured to define an open area between the support surface and the laterally extending lip, wherein the hook section of the anti-tip member is disposed in the open area; and wherein the anti-tip member includes a retainer section located opposite the hook section and the finger section relative to the pivot axis, and wherein the releasable retainer arrangement is engageable with the retainer section for retaining the anti-tip member in the operative position.

6. A method of engaging an anti-tip member with a rail arrangement, wherein the anti-tip member is carried by a movable member adapted to be movably supported by the rail arrangement, and wherein the rail arrangement includes a generally horizontal support surface and a laterally extending engagement surface laterally offset from the support surface, comprising the steps of:

pivoting the anti-tip member from an inoperative position to an operative position about a pivot axis by manually manipulating a finger section defined by the anti-tip member, wherein the anti-tip member includes a hook section that is disengaged from the engagement surface of the rail arrangement when the anti-tip member is in the inoperative position and is located adjacent the engagement surface of the rail arrangement when the anti-tip member is in the operative position, and wherein the finger section of the anti-tip member is vertically spaced above the hook section of the anti-tip member; and engaging a releasable retainer member with the anti-tip member for releasably retaining the anti-tip member in the operative position, by engaging the releasable retainer member with a retainer section of the anti-tip member located opposite the pivot axis from the finger section.

7. The method of claim 6, wherein the movable member comprises a carriage adapted to support one or more storage units, wherein the carriage defines an outwardly facing end area spaced above the support surface of the rail arrangement, and wherein the step of pivoting the anti-tip member from the inoperative position to the operative position is carried out by manipulating the finger section of the anti-tip member from a first location outwardly of the end area of the carriage, and wherein the step of engaging the releasable retainer with the anti-tip member is carried out from a second location outwardly of the end area of the carriage and laterally offset from the first location.

8. The method of claim 6, wherein the step of pivoting the anti-tip member from the inoperative position to the operative position is carried out by engaging the finger section and lifting the finger section upwardly to position the anti-tip member such that the hook section of the anti-tip member is located adjacent and below the engagement surface of the rail arrangement.

9. The method of claim 8, wherein the step of pivoting the anti-tip member from the inoperative position to the operative position is carried out by initially engaging the anti-tip member with the rail arrangement as the movable member is engaged with the rail arrangement to move the anti-tip member partially toward the operative position from the inoperative position, and by subsequently lifting the finger section of the anti-tip member upwardly to place the anti-tip member in the operative position.

10. The method of claim 9, wherein the rail arrangement comprises an upwardly facing channel member and wherein the support surface is defined by a support bar mounted to the channel member, wherein the laterally extending engagement surface of the rail arrangement is defined by a lip that extends inwardly from a side wall defined by the channel member, and wherein the step of partially moving the anti-tip member toward the operative position from the inoperative position is carried out by engaging the finger section of the anti-tip member with the lip as the movable member is moved into engagement with the rail arrangement.

11. In a mobile system in which a movable member is movably supported on an axially extending rail arrangement having a support surface, wherein an anti-tip member having a hook section and a retainer section are carried by the movable member, and wherein the anti-tip member is pivotable in a vertical direction about a pivot axis between an operative position and an inoperative position and is adapted to be releasably retained in the operative position during use of the mobile system, wherein the hook section extends in a first direction from the pivot axis and opposite to the retainer section the improvement comprising a tab section associated with the anti-tip member, wherein the tab section extends in the first direction from the pivot axis wherein the tab section is spaced vertically above the hook section and is configured so as to be manually engageable by a user to enable the user to pivot the anti-tip member from the inoperative position to the operative position.

12. The improvement of claim 11, wherein the rail arrangement includes a laterally extending engagement surface laterally spaced from the support surface, wherein the hook section of the anti-tip member is located vertically below and adjacent the laterally extending engagement surface when the anti-tip member is in the operative position, and wherein the tab section is located vertically above and adjacent the laterally extending engagement surface.

13. In a mobile system in which a movable member is movably supported on an axially extending rail arrangement having a support surface, wherein an anti-tip member having a hook section is carried by the movable member, and wherein the anti-tip member is pivotable in a vertical direction about a pivot axis between an operative position and an inoperative position and is adapted to be releasably retained in the operative position during use of the mobile system, the improvement comprising:

a tab section associated with the anti-tip member, wherein the tab section is spaced vertically above the hook section and is configured so as to be manually engageable by a user to enable the user to pivot the anti-tip member from the inoperative position to the operative position:

wherein the rail arrangement includes a laterally extending engagement surface laterally spaced from the support surface, wherein the hook section of the anti-tip member is located vertically below and adjacent the laterally extending engagement surface when the anti-tip member is in the operative position, and wherein the tab section is located vertically above the laterally extending engagement surface; and wherein the anti-tip member is releasably retained in the operative position by means of a releasable retainer member engaged with a retainer section defined by the anti-tip member, wherein the releasable retainer section of the anti-tip member is located opposite the tab section relative to the pivot axis of the anti-tip member.

14. The improvement of claim 13, wherein the tab section and the retainer section are arranged to extend generally linearly in opposite directions from the pivot axis of the anti-tip member.

15. The improvement of claim 13, wherein the rail arrangement includes a support bar mounted to an upwardly facing channel, wherein the support bar defines the support surface, and wherein the laterally extending engagement surface comprises a lip defined by the channel that is laterally offset from the support surface.

16. The improvement of claim 15, wherein the tab section is constructed and arranged to engage the lip of the channel as the movable member is moved toward the rail arrangement to partially move the anti-tip member from the inoperative position toward the operative position, and wherein the anti-tip member is moved to the operative position by manual engagement with the tab section subsequent to engagement of the movable member with the rail arrangement.

17. An anti-tip arrangement for a mobile system including a movable member movably supported on a rail arrangement having a support surface, comprising:

a laterally extending engagement area defined by the rail arrangement;

anti-tip means mounted to the movable member for preventing the movable member from tipping relative to the rail arrangement, wherein the anti-tip means includes a hook section and a retainer section and is pivotable about a pivot axis between an operative position and a release position, wherein the hook section extends in a first direction from the pivot axis and opposite to the retainer section and is located vertically below and adjacent the laterally extending engagement area when the anti-tip means is in the operative position, and wherein the anti-tip means further includes engagement structure located vertically above the hook section and extending in the first direction from the pivot axis, wherein the engagement structure is located vertically above the laterally extending engagement area when the anti-tip member is in the operative position and is configured so as to be manually engaged by a user and subjected to an upward force for enabling the user to manually move the anti-tip means to the operative position; and releasable retainer means for releasably retaining the anti-tip means in the operative position.

18. The anti-tip arrangement of claim 17, wherein the anti-tip means comprises an anti-tip member pivotably mounted to the movable member for movement about the pivot axis between the operative position and the inoperative position.

19. The anti-tip arrangement of claim 18, wherein the engagement structure comprises an engagement member extending from the pivot axis and located vertically above the hook section.

20. The anti-tip arrangement of claim 19, wherein the releasable retainer means comprises said retainer section defined by the anti-tip member, and a releasable retainer member engageable with the retainer section and with the movable member for releasably retaining the anti-tip member in the operative position.

* * * * *